United States Patent [19]

Hirabayashi

[11] 4,456,363

[45] Jun. 26, 1984

[54] PAPER FEEDING ARRANGEMENT FOR COPYING APPARATUS

[75] Inventor: Tsugio Hirabayashi, Hachioji, Japan

[73] Assignee: Konishiroku Photo Industry Co., Ltd., Tokyo, Japan

[21] Appl. No.: 348,449

[22] Filed: Feb. 12, 1982

[30] Foreign Application Priority Data

Feb. 24, 1981 [JP] Japan ..... 56-26632

[51] Int. Cl.[3] ..... G03G 15/00

[52] U.S. Cl. ..... 355/3 R; 355/3 SH

[58] Field of Search ..... 355/3 R, 3 DR, 3 SH, 355/16, 133, 14 SH; 271/246, 264, 275, 276, 277

[56] References Cited

U.S. PATENT DOCUMENTS 3,736,053 5/1973 Shreere et al. ..... 355/3 DR
4,009,957 3/1977 Suzuki et al. ..... 355/14 SH
4,236,807 12/1980 Kuehnle ..... 355/16 X
4,327,992 5/1982 Babicz ..... 355/3 DR X
4,330,196 5/1982 Yamaguchi ..... 355/3 R X

*Primary Examiner*—J. V. Truhe
*Assistant Examiner*—J. Pendegrass
*Attorney, Agent, or Firm*—Jordan B. Bierman; Linda Bierman

[57] ABSTRACT

In an electrophotographic copying apparatus in which the photosensitive drum and associated image forming, developing and cleaning devices are all supported in a subframe movable into and out of a main frame which carries the copy plate and associated optical system, the main power source and the primary paper feeding cassette, paper feeding device in the form of register rollers timed with the operation of the drum, are mounted on the subframe and are adapted to receive paper from the cassette when the subframe is positioned within the main frame and the drum and other operating devices are connected to the main power source.

2 Claims, 2 Drawing Figures

PAPER FEEDING ARRANGEMENT FOR COPYING APPARATUS

BACKGROUND OF THE INVENTION

The present invention relates to a copying apparatus. In the conventional copying apparatus such as an electrophotographic copying apparatus, for example, there has been adopted an arrangement wherein all of the operative units or parts are arranged in a predetermined relationship in succession on the main frame of the copying apparatus and the units or parts necessary for the processes related to the forming and transferring of images from an image-forming member such as a photosensitive substance drum etc. up to a charging unit, a developing unit, a paper-feeding unit, a transferring unit, a separation unit and a cleaning unit etc. are arranged about the image-forming member. When assembling, adjusting, maintaining and replacing these units or parts, the problem that other units or parts may obstruct each other arises and considerable time is required and stable and precise adjustments must be expected.

Certain of said problems have been solved heretofore with the invention described in Japanese Laid-Open Patent Application No. 2433/1976. Namely; an image-forming member unit formed in one united body on a supporting frame body engages with the main frame of a copying apparatus in an attachable and detachable manner with the aid of a guide member. The member unit comprises an image-forming member, developing means and cleaning means, all in a predetermined position relationship.

With the adoption of such construction, the assembly may be completed by locating and fixing, according to the guide member, the supporting member whose assembly is finished after the perfect adjustment of the position relation between the image-forming member and each process unit at the prescribed position on the main frame of the copying apparatus.

In other words, maintenance and replacement may be done easily, after the supporting member on which the assembly is made is drwan out from the main frame of the apparatus, without interference with other supporting members and devices. Accordingly, it is possible that the work may be done efficiently, quickly and precisely.

Unification of the function or process in the aforesaid copying apparatus, due to the demand for compactness of the apparatus itself, has brought about the development of individual functional units such as a drum unit, a paper-feeding unit, a developing unit, an optical unit, a cleaning unit, a conveying unit, a fixing unit, a paper-ejecting unit or a driving unit etc., for example, and thereby there has resulted many advantages not only in simplicity and ease of assembly but also an improvement in maintenance, also an improvement in maintenance, and furthermore the interchangeability for the replacement of parts is easily obtained.

Regarding the paper-feeding unit, however, the arrangement has been such unit that the image-forming member unit side has no functional relationship to the transport of recording papers although the function of feeding out recording papers, the function of preventing double feeding, and the function of positioning relative to the toner image on the image-forming member etc. are all united in one apparatus. Thus, in the case of a unit construction as above, constant adjustment of the clearance and the extent of parallelism between the image-forming member and the paper-feeding unit is necessary in order to precisely maintain the position of the transferred image on the recording paper at all times. There also exists the problem that a special connection should be used occasionally because the adjustment of the driving system is further needed and it is necessary to adjust the traveling speed of the image-forming member and the speed of revolution of the register roller, and accordingly trouble must be taken that certain means to make a common driving system for both is required.

SUMMARY OF THE INVENTION

An object of the present invention is to offer a copying apparatus wherein the aforesaid drawbacks have been avoided, and adjustments including that of the positional relationship between an image-forming member and a timed paper-feeding means. Other objects of the present invention will be apparent from following detailed description thereof with reference to the drawings. Such objects will be achieved by a copying apparatus wherein the image-forming member and the timed paper-feeding means that further feeds a recording paper fed by the primary paper-feeding means in synchronism with the toner image on aforesaid image-forming member, all supported on the same supporting frame as one united body.

DESCRIPTION OF THE PREFERRED EMBODIMENT

Figure 1:
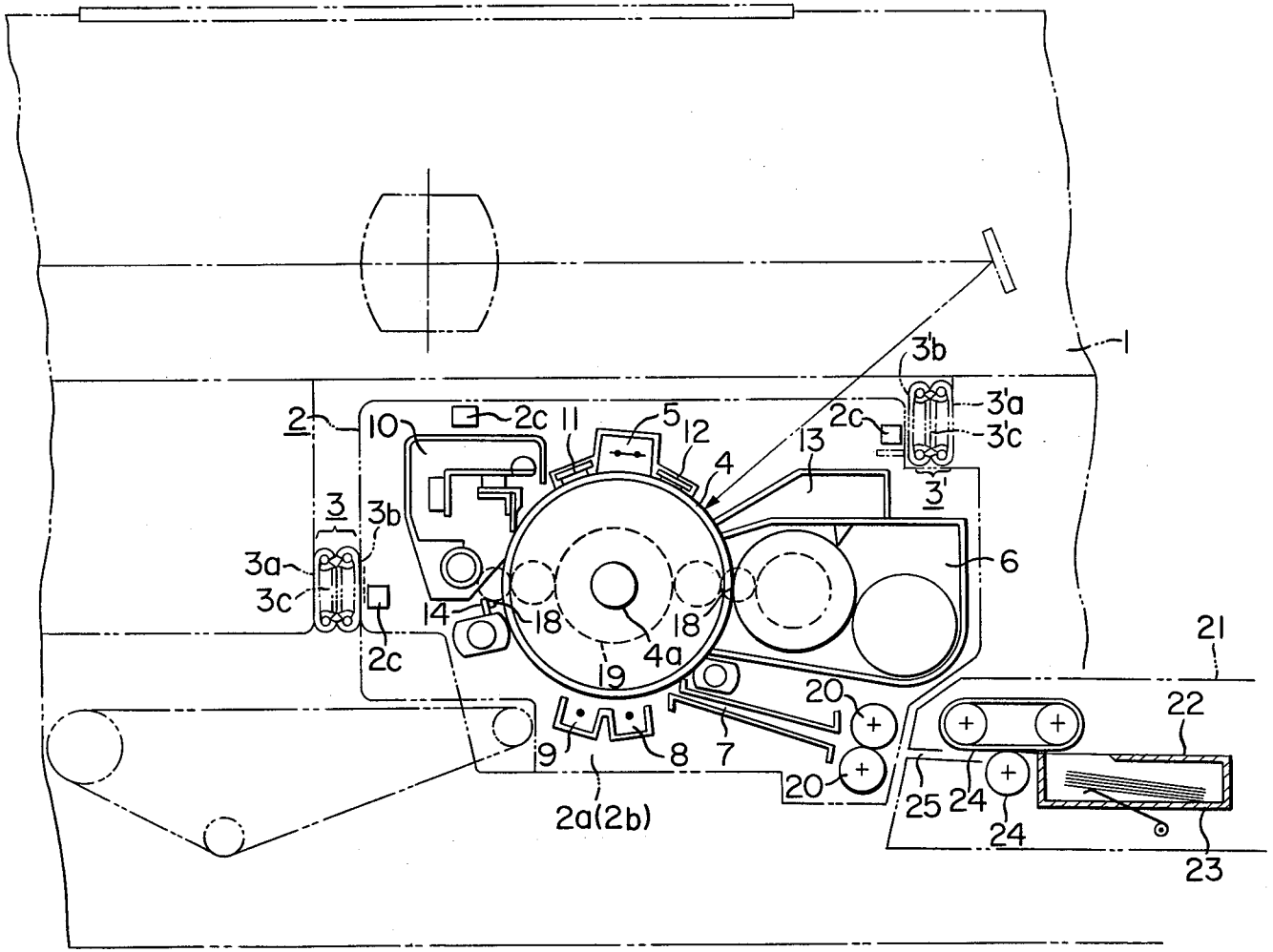
FIG. 1 is a front view of the main portion of the copying apparatus of the present invention.

The copying apparatus of the present invention will be explained as follows referring to the drawings.

Figure 2:
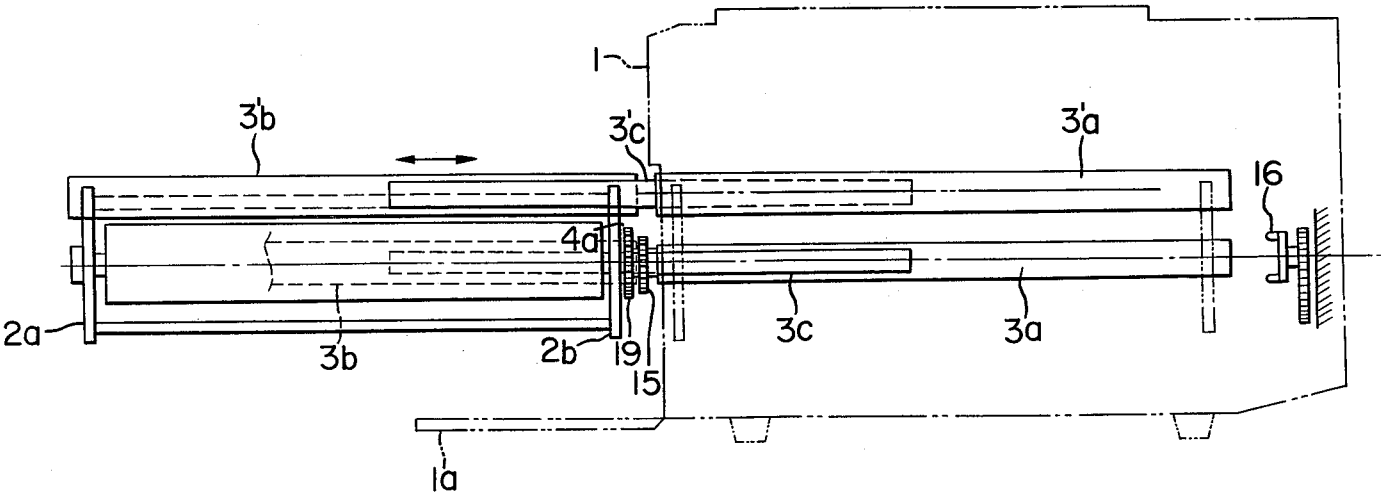
FIG. 2 is a side view showing the condition in which the supporting member to which the photosensitive drum and others are devices attached to and removed from the main frame of the copying apparatus.

FIG. 1 is a front view of the main portion of the copying apparatus of the present invention. FIG. 2, on the other hand, is a side view showing the condition in which the supporting member to which the photosensitive drum and other attached image-forming devices have been removed from the main frame of the copying apparatus.

In the drawings, 1 is the main frame of the coyping apparatus, 2 is a supporting frame body consisting of side plates 2*a* and 2*b* and cross beam 2*c* that interconnects such side plates; the supporting frame body 2 engages main frame of the copying apparatus in an attachable and detachable manner with the aid of the guide rails 3 and 3'.

Guide rails 3 and 3' consist of the rails 3*a* and 3'*a* fixed on the side of the main frame of the copying apparatus 1, while rails 3*b* and 3'*b* are fixed to the side of the supporting frame body 2; the joint runners 3*c* and 3'*c* that engage with the rails on the sides of both main frame and spporting frame body and are movable and contact to the rails through the rolling balls (not shown) in order to minimize the traveling resistance. Such guide rails 3 and 3' can either be ones with stoppers with which the supporting frame body 2 is stopped at the point at which it is taken out from the main frame of the copying apparatus 1, or the ones with which the supporting frame body 2 can completely to removed from the main frame of the copying apparatus 1. On the removable supporting frame body 2 there are attached process units necessary for image forming such as a photosensitive substance drum 4, a charging electrode 5, a developing unit 6, a paper-feeding guide 7, transfer electrode 8, a separation electrode 9 and a cleaning unit 10 and other devices arranged in such a way that they maintain a certain positional relation with respect to the photosensitive substance drum 4.

Photosensitive drum 4 has a driving gear 19 to drive the process units and the coupling receiving member 15 to receive the turning force at a position extending from the supporting frame side plate 2*b* that is on the edge of the shaft 4*a* of the photosensitive substance drum 4.

In the meantime, the coupling driving member 16 attached to a power unit (not shown) that is provided on the side of the main frame of the copying apparatus 1 and is arranged so that the coupling receiving member 15 and the coupling driving member 16 are interlocked whenever the supporting frame body 2 to which the photosensitive substance drum 4 and others are attached is loaded into the main frame of the copying apparatus 1. The driving gear 19 of the photosensitive drum 4 drives the rotating portions of the developing unit 6 and the cleaning unit 10 and other devices through the intermediate gears 17 and 18 etc.

Attaching, detaching and adjustment of the photosensitive drum 4 and others devices are made whenever the supporting frame body 2 is taken out of the main frame of the copying apparatus 1 as shown in FIG. 2 or it is removed from the main frame of the copying apparatus 1, and attachment to the main frame of the copying apparatus 1 is made by feeding the supporting frame body 2 to which they are attached into the main frame 1 of the copying apparatus with the aid of the guide rail and by fixing them with a proper fixing means.

In the illustrated example, the construction is so made that the supporting frame body 2 will be in a condition to be taken out if the front door 1*a* of the main frame of the copying apparatus 1 is opened, and if the front door 1*a* is closed and latched, the supporting frame body 2 will be fixed at a certain position, being pressed by the front door 1*a*.

If the supporting frame body 2 is pushed into the main frame of the copying apparatus 1 and is fixed in place the coupling receiving member 15 of the photosensitive drum 4 and the coupling driving member 16 on the side of the main frame of the copying apparatus engage each other as mentioned above, and the photosensitive drum 4 is driven by the driving of the coupling driving member 16 through the coupling receiving member 15 and at the same time, each process unit is driven through the driving gear 19.

A coupling joint wherein the driven side and the driving side automatically engage when the driving shaft rotates despite a divergence of the phase between the driven side and the driving side is to be used.

In the copying apparatus of the present invention illustrated, in order to solve the aforesaid problems related to the mechanical adjustment between the photosensitive drum that is an image-forming member like the one seen in the conventional copying apparatus and a pair of register rollers 20 which are the secondary paper feeding members, a pair of these are incorporated in the supporting frame body 2 of the image-forming member constructed according to the foregoing.

Accordingly, the adjustment function relating to the feed-out timing of the leading edge of the paper, skewing of the paper and the speed gap between the photosensitive drum and the register rollers, etc. among the paper-feeding functions of the conventional paper-feeding unit are all transferred to the side of the photosensitive drum unit.

In the meantime, since the photosensitive substance drum unit is constructed with a supporting frame before and behind holding the drum as mentioned above, it is possible to easily realize the above-mentioned adjustment function by the accuracy of parts of this supporting frame body alone.

In the copying apparatus of the present invention, therefore, the paper-feeding unit 21 has only to have the function that the recording paper is fed out within a certain time. The numeral 22 is a paper-feding cassette to accept the recording papers 23, 24 is a feed-out roller for the recording paper as the primary paper-feeding means and 25 is a conveyance guide for the recording papers.

In the copying apparatus of the present invention, the original function to be owned by the time paper-feeding means can easily be maintained within an assembly for the image-forming member unit because the timed paper-feeding means is incorporated in the supporting frame body of the image-forming member as one unit, and also the paper-feeding unit can be arranged without any necessity of fine adjustment relative to the image-forming member because the function of entire paper-feeding unit is simplified; therefore the arrangement is extremely useful for an improvement in the efficiency of both assembly and maintenance work.

What is claimed is:

1. In an electrophotographic copying apparatus of the type in which a main frame supports a copy plate and the associated optical system, a paper feeding cassette, primary paper feeding means and a conveyance guide therefor, a primary driving power source, and a subframe supported for lateral movement into and out of the lateral boundaries of the main frame and carrying a photosensitive drum and associated image forming, developing and cleaning means and a drive shaft for the same engageable with the primary driving power source when said subframe is positioned wholly within said main frame, the improvement comprising paper feeding means timed relatively to the rotation of said drum, mounted on said subframe to feed paper into operable relationship with said drum, and in which the paper feeding means on said subframe is positioned in operable relationship with said primary paper feeding means on said main frame to receive paper therefrom when said subframe is positioned wholly within said main frame and said drive shaft is engaged with the primary driving power source.

2. In an electrophotographic copying apparatus according to claim 1, in which said improvement includes forming said timed paper feeding means of a pair of register rollers.

* * * * *